US011576537B2

(12) United States Patent
Simison

(10) Patent No.: US 11,576,537 B2
(45) Date of Patent: Feb. 14, 2023

(54) WEIGHTED-CORNER TOWEL APPARATUS

(71) Applicant: Tiffany Simison, Mobile, AL (US)

(72) Inventor: Tiffany Simison, Mobile, AL (US)

( * ) Notice: Subject to any disclaimer, the term of this patent is extended or adjusted under 35 U.S.C. 154(b) by 98 days.

(21) Appl. No.: 17/103,083

(22) Filed: Nov. 24, 2020

(65) Prior Publication Data

US 2022/0160186 A1 May 26, 2022

(51) Int. Cl.
*A47K 10/02* (2006.01)
*A47G 9/06* (2006.01)

(52) U.S. Cl.
CPC ..... *A47K 10/02* (2013.01); *A47G 9/062* (2013.01); *Y10S 242/919* (2013.01)

(58) Field of Classification Search
CPC ..... A47G 9/06; A47G 9/062; A47G 11/003; A47G 11/00; Y10S 242/919; Y10S 248/91; A45C 15/00; A45C 3/10; A47K 10/02; E04H 15/003; Y10T 428/2395; A47C 31/10
See application file for complete search history.

(56) References Cited

U.S. PATENT DOCUMENTS

| | | | | |
|---|---|---|---|---|
| 3,226,737 | A | 1/1966 | Rote | |
| 4,223,056 | A | 9/1980 | Di Fronzo | |
| 4,654,906 | A | 4/1987 | Roberts | |
| 5,018,229 | A | 5/1991 | Eberhart | |
| 5,072,467 | A * | 12/1991 | Hunt | A47G 9/062 5/419 |
| 5,499,411 | A * | 3/1996 | Wong | A47G 9/062 5/417 |
| 2005/0005355 | A1 * | 1/2005 | Marks | A47G 9/062 5/417 |
| 2006/0024471 | A1 | 2/2006 | Cunningham | |
| 2016/0037944 | A1 * | 2/2016 | Savignano | A47G 9/062 5/636 |

* cited by examiner

*Primary Examiner* — David R Hare
*Assistant Examiner* — Madison Emanski

(57) ABSTRACT

A weighted-corner towel apparatus for maintaining position of a towel includes a towel body having a body top side, a body bottom side, and a rectangular body perimeter including four corners. A plurality of weight pockets is coupled to the towel body. Each weight pocket is coupled to the body bottom side adjacent one of the corners of the body perimeter. A plurality of weight beads is coupled within the plurality of weight pockets. The towel body and each of the plurality of weight pockets is a heat and water-resistant material.

7 Claims, 5 Drawing Sheets

WEIGHTED-CORNER TOWEL APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to towel devices and more particularly pertains to a new towel device for maintaining position of a towel.

(2) Description of Related Art Including Information Disclosed Under 37 CFR 1.97 and 1.98

The prior art relates to towel devices. Known devices have pockets that can be filled with sand or otherwise weighted. These devices typically lack permanently fixed bean bag weights. These devices also do not include selectively engageable weights with a pocket to secure these weights.

BRIEF SUMMARY OF THE INVENTION

An embodiment of the disclosure meets the needs presented above by generally comprising a towel body having a body top side, a body bottom side, and a rectangular body perimeter including four corners. A plurality of weight pockets is coupled to the towel body. Each weight pocket is coupled to the body bottom side adjacent one of the corners of the body perimeter. A plurality of weight beads is coupled within the plurality of weight pockets. The towel body and each of the plurality of weight pockets is a heat and water-resistant material.

An alternative embodiment of the disclosure generally comprises a towel body having a body top side, a body bottom side, and a rectangular body perimeter including four corners. A plurality of weight pockets is coupled to the towel body. Each weight pocket has a flat pocket top side and a pocket bottom side coupled to the pocket top side to define a pocket inside. The pocket top side has a first fastener selectively engageable with a second fastener coupled to the body bottom side of the towel body. A plurality of weight beads is coupled within the plurality of weight pockets. The plurality of weight beads is coupled within the pocket inside. A storage pouch is coupled to the towel body to selectively receive the plurality of weight pockets. The storage pouch has a pouch body and a pouch flap. The pouch body has a first pouch fastener and the pouch flap has a second pouch fastener. The first pouch fastener and the second pouch fastener are selectively engageable.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
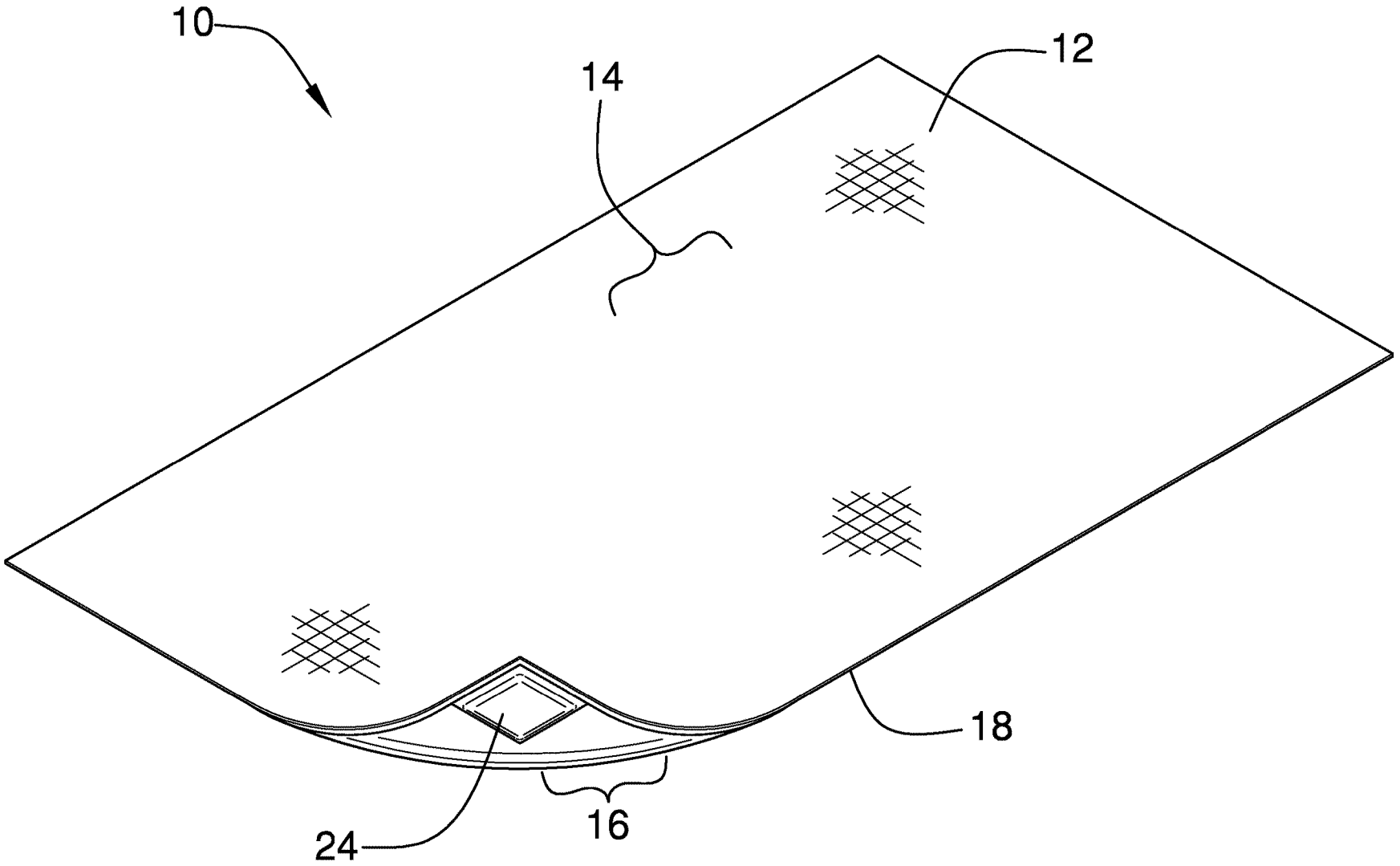
FIG. 1 is an isometric view of a weighted-corner towel apparatus according to an embodiment of the disclosure.
Figure 2:
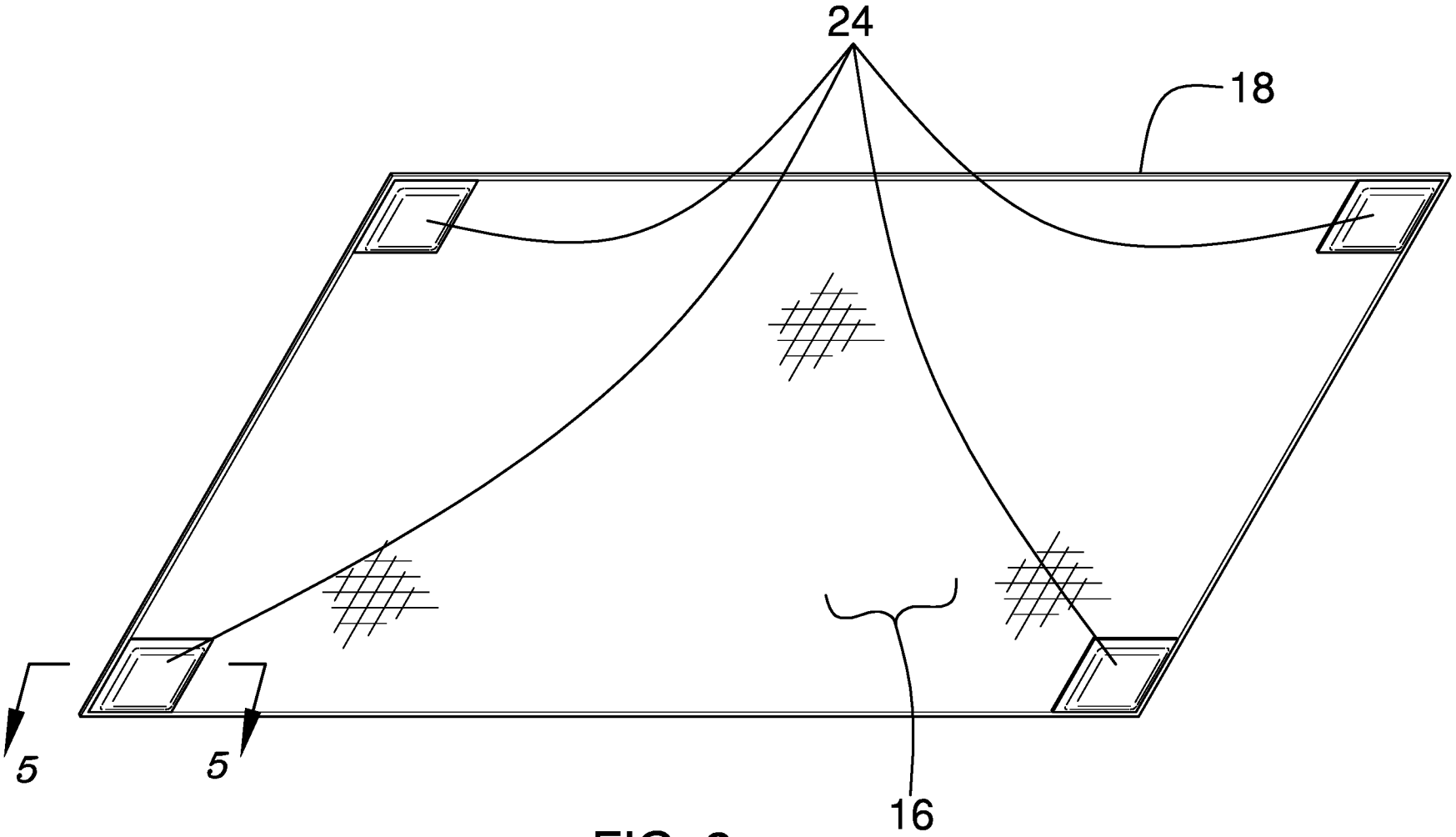
FIG. 2 is an isometric view of an embodiment of the disclosure.
Figure 3:
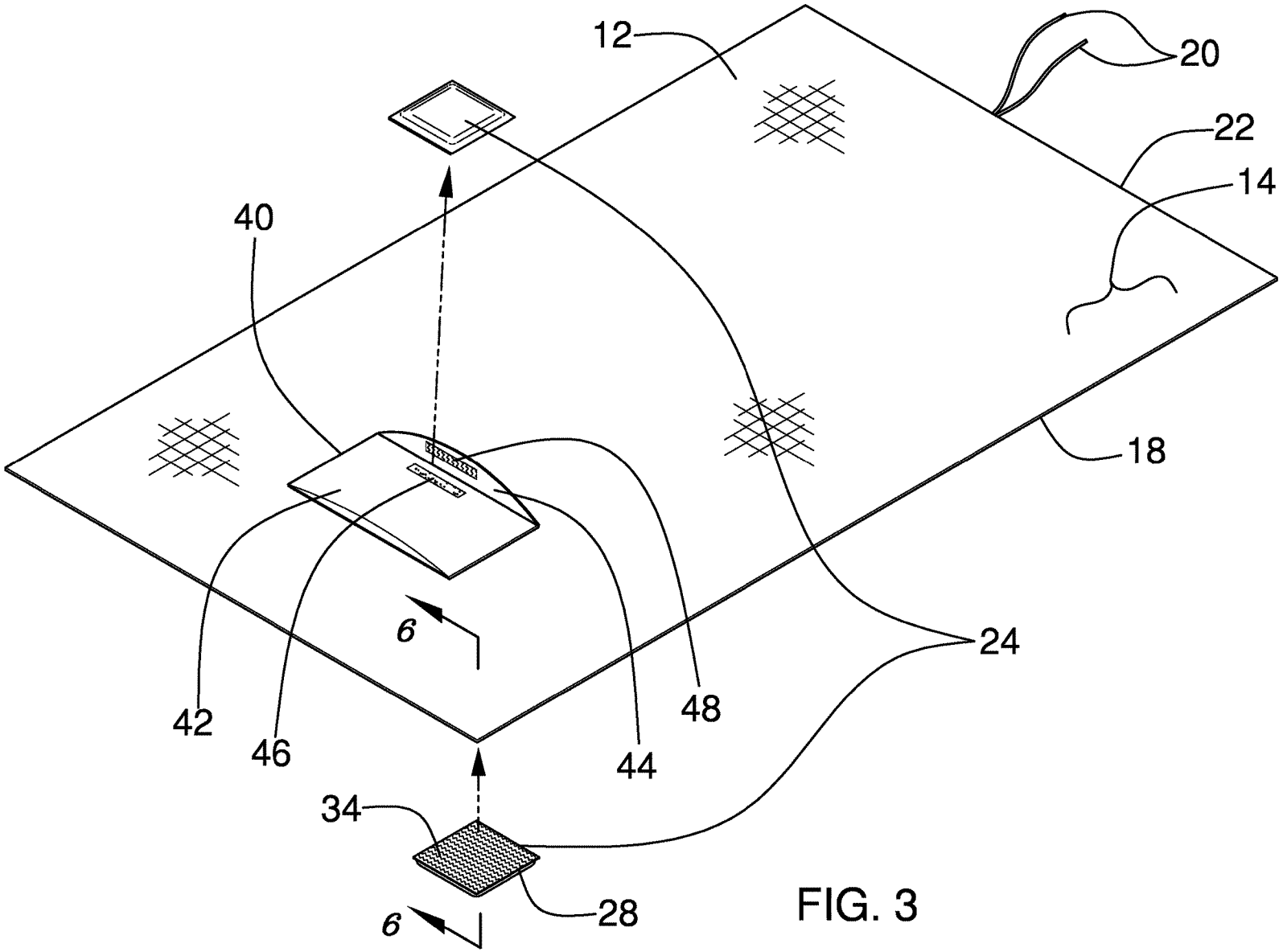
FIG. 3 is an isometric view of an embodiment of the disclosure.
Figure 4:
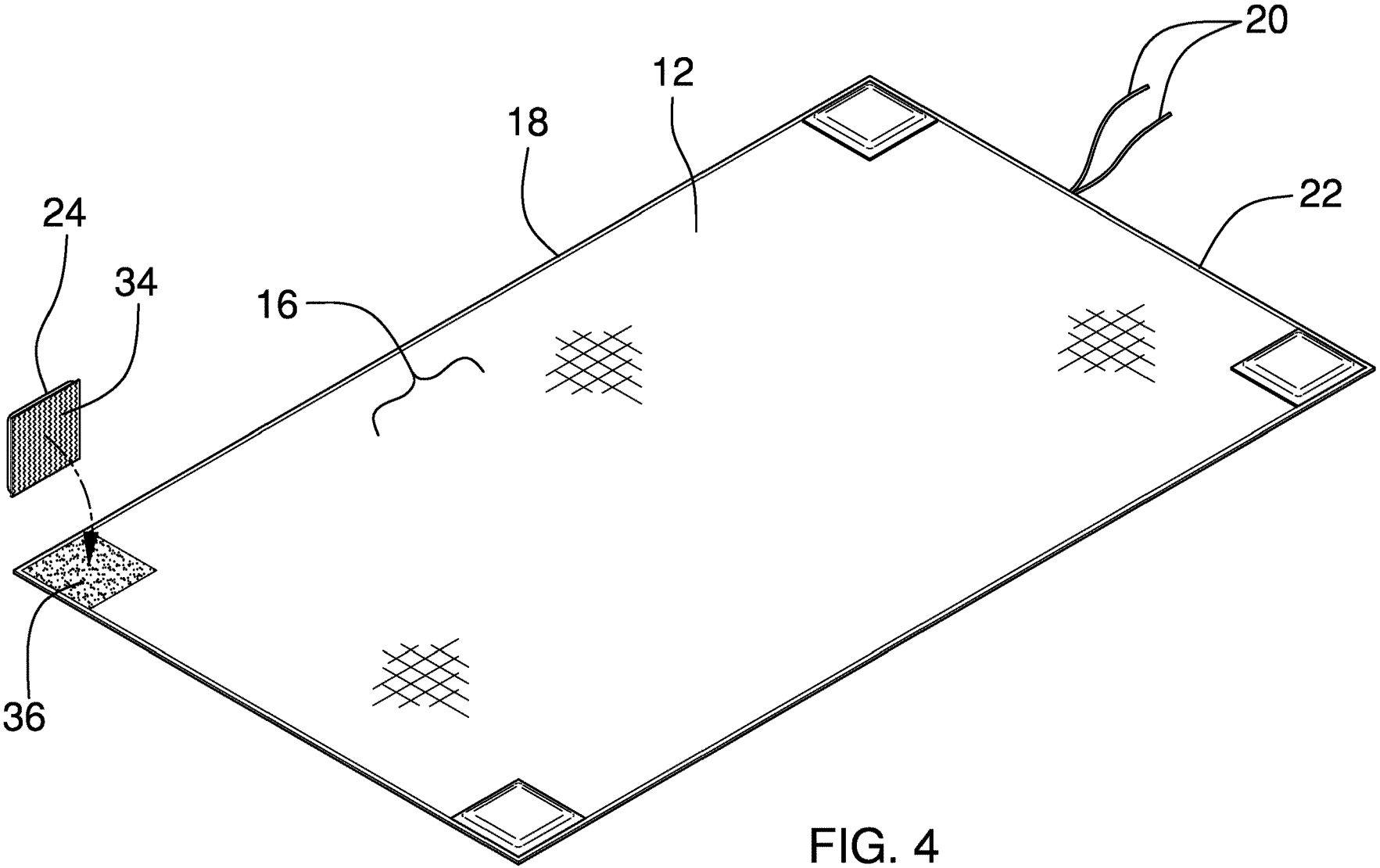
FIG. 4 is an isometric view of an embodiment of the disclosure.

With reference now to the drawings, and in particular to FIGS. 1 through 6 thereof, a new towel device embodying the principles and concepts of an embodiment of the disclosure and generally designated by the reference numeral 10 will be described.

Figure 5:
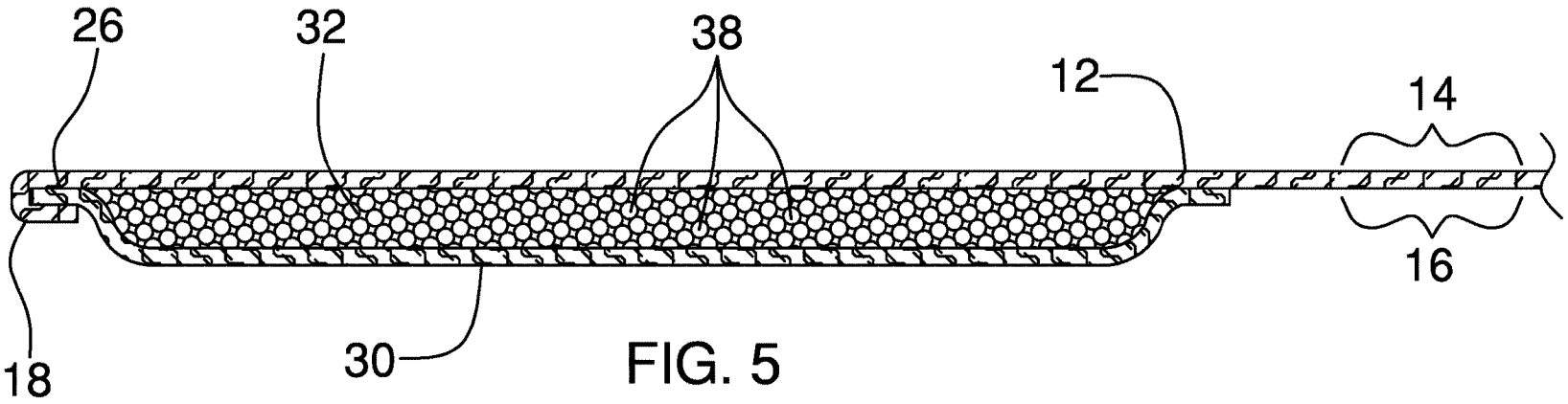
FIG. 5 is a cross-sectional view of an embodiment of the disclosure along the line 5-5 of FIG. 2.
Figure 6:
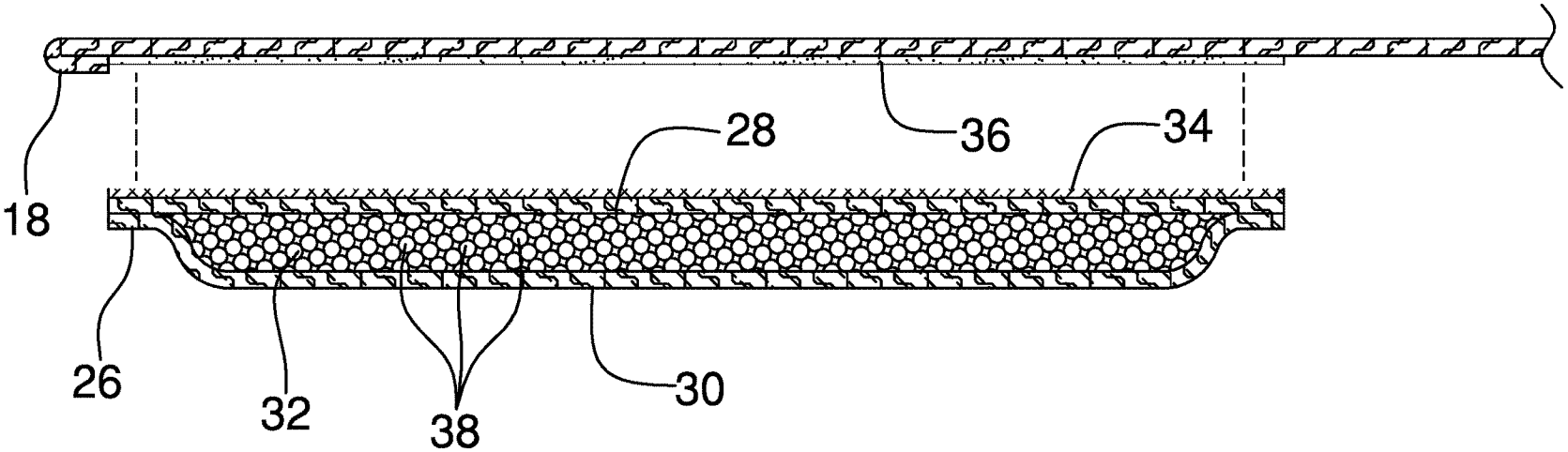
FIG. 6 is a cross-sectional view of an embodiment of the disclosure along the line 6-6 of FIG. 3.

As best illustrated in FIGS. 1 through 6, the weighted-corner towel apparatus 10 generally comprises a towel body 12. The towel body 12 has a body top side 14, a body bottom side 16, and a rectangular body perimeter 18 including four corners. The body perimeter 18 of the towel body may be folded as shown in FIGS. 5 and 6.

There may be pair of tie-down straps 20 coupled to the towel body 12. The pair of tie-down straps 20 is coupled to the body perimeter 18 and is configured to be tied around an object such as an umbrella pole. The pair of tie-down straps 20 may be medially coupled along a head edge 22 of the body perimeter.

A plurality of weight pockets 24 is coupled to the towel body 12. Each weight pocket 24 may be directly coupled to the body bottom side 16 as shown in FIG. 5. The body perimeter 18 may be folded around a lip 26 of each weight pocket. In an alternative embodiment of the invention shown in FIGS. 3, 4, and 6, each weight pocket 24 has a flat pocket top side 28 and a pocket bottom side 30 coupled to the pocket top side 28 to define a pocket inside 32. The pocket top side 28 has a first fastener 34 selectively engageable with a second fastener 36 coupled to the body bottom side 16 of the towel body.

In each embodiment the plurality of weight pockets 24 may be coupled adjacent the corners of the body perimeter 18. Each weight pocket 24 may be square. A plurality of weight beads 38 is coupled within the plurality of weight pockets 24. The plurality of weight beads 38 is coupled within the pocket inside 32 to weight the corners of the body perimeter 18 and prevent the towel body 12 from being displaced in windy conditions. The towel body 12 and each of the plurality of weight pockets 24 may be a heat and water-resistant material.

A storage pouch 40 is coupled to the towel body 12. The storage pouch 40 selectively receives the plurality of weight pockets 24 when disengaged from the body bottom side 16 to prevent misplacement. The storage pouch 40 has a pouch body 42 and a pouch flap 44. The pouch body 42 has a first pouch fastener 46 and the pouch flap 44 has a second pouch fastener 48. The first pouch fastener 46 and the second pouch fastener 48 are selectively engageable to seal the plurality of weight pockets 24 within the storage pouch 40. Each of the first fastener 34, the second fastener 36, the first pouch fastener 46, and the second pouch fastener 48 may be, but are not limited to, selectively engageable fasteners such as hook-and-loops, snaps, and the like.

In use, the plurality of weight pockets 24 is engaged with the body bottom side 16 using the first fastener 34 and the second fastener 36. The pair of tie-down straps 20 may be tied around a stable object. The apparatus 10 is then enjoyed like a traditional towel without worry of windy conditions.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weighted-corner towel apparatus comprising:

a towel body, the towel body having a body top side, a body bottom side, and a rectangular body perimeter including four corners;

a plurality of weight pockets coupled to the towel body, each weight pocket being coupled to the body bottom side adjacent one of the corners of the body perimeter, each weight pocket having a flat pocket top side and a pocket bottom side coupled to the pocket top side to define a pocket inside, the pocket top side having a first fastener selectively engageable with a second fastener coupled to the body bottom side of the towel body wherein each weight pocket is selectively removable from the towel body; and a plurality of weight beads coupled within the plurality of weight pockets, the plurality of weight beads being coupled within the pocket inside;

wherein the towel body and each of the plurality of weight pockets is a heat and water-resistant material.

2. The weighted-corner towel apparatus of claim 1 further comprising a pair of tie-down straps coupled to the towel body, the pair of tie-down straps being coupled to the body perimeter.

3. The weighted-corner towel apparatus of claim 1 further comprising the body perimeter of the towel body being folded around a lip of each weight pocket.

4. The weighted-corner towel apparatus of claim 1 further comprising each weight pocket being square.

5. The weighted-corner towel apparatus of claim 1 further comprising a storage pouch coupled to the towel body, the storage pouch selectively receiving the plurality of weight pockets.

6. The weighted-corner towel apparatus of claim 5 further comprising the storage pouch having a pouch body and a pouch flap, the pouch body having a first pouch fastener and the pouch flap having a second pouch fastener, the first pouch fastener and the second pouch fastener being selectively engageable.

7. A weighted-corner towel apparatus comprising:

a towel body, the towel body having a body top side, a body bottom side, and a rectangular body perimeter including four corners, the body perimeter of the towel body being folded;

a pair of tie-down straps coupled to the towel body, the pair of tie-down straps being coupled to the body perimeter;

a plurality of weight pockets coupled to the towel body, each weight pocket having a flat pocket top side and a pocket bottom side coupled to the pocket top side to define a pocket inside, the pocket top side having a first fastener selectively engageable with a second fastener coupled to the body bottom side of the towel body adjacent one of the corners of the body perimeter wherein each weight pocket is selectively removable from the towel body, each weight pocket being square;

a plurality of weight beads coupled within the plurality of weight pockets, the plurality of weight beads being coupled within the pocket inside;

wherein the towel body and each of the plurality of weight pockets is a heat and water-resistant material; and a storage pouch coupled to the towel body, the storage pouch selectively receiving the plurality of weight pockets; the storage pouch having a pouch body and a pouch flap, the pouch body having a first pouch fastener and the pouch flap having a second pouch fastener, the first pouch fastener and the second pouch fastener being selectively engageable.

* * * * *